US007178207B2

(12) United States Patent
Wong et al.

(10) Patent No.: US 7,178,207 B2
(45) Date of Patent: Feb. 20, 2007

(54) MAGNETIC FASTENER

(76) Inventors: Sheung Chung Wong, Room 1011-1016, A, B, C, 10/F., Wang Cheong Ind. Bldg., 781 Lai Chi Kok Road, Kowloon, Hong Kong (HK); Shang Rong Huang, Da Lang Ying Tai Industrial District, Bao An District, Long Huan Zhen, Shenzhen City (CN); Tung Wong, Room 1011-1016, A, B, C, 10/F., Wang Cheong Ind. Bldg., 781 Lai Chi Kok Road, Kowloon, Hong Kong (HK)

( * ) Notice: Subject to any disclaimer, the term of this patent is extended or adjusted under 35 U.S.C. 154(b) by 0 days.

(21) Appl. No.: 10/411,142

(22) Filed: Apr. 11, 2003

(65) Prior Publication Data

US 2004/0200043 A1 Oct. 14, 2004

(51) Int. Cl.
*A44B 21/00* (2006.01)
*A44B 17/00* (2006.01)

(52) U.S. Cl. ..... 24/303; 24/459

(58) Field of Classification Search ..... 24/303, 24/66.1, 606, 683; 292/251.5; 63/29.2; 248/206.5; 335/285

See application file for complete search history.

(56) References Cited

U.S. PATENT DOCUMENTS 3,009,225 A * 11/1961 Budreck ..... 24/303
4,779,314 A * 10/1988 Aoki ..... 24/303
5,092,019 A * 3/1992 Levy ..... 24/303
5,367,891 A * 11/1994 Furuyama ..... 63/29.2
5,722,126 A * 3/1998 Reiter ..... 24/303
5,895,018 A * 4/1999 Rielo ..... 248/206.5
5,933,926 A * 8/1999 Reiter ..... 24/303
5,987,715 A * 11/1999 Khon ..... 24/303
6,163,938 A * 12/2000 Weber-Unger ..... 24/303
6,215,381 B1 * 4/2001 Aoki ..... 292/251.5
6,622,349 B2 * 9/2003 Wong ..... 24/303

FOREIGN PATENT DOCUMENTS

DE 2 323 058 A 11/1974
DE 29 29 698 A 2/1981
DE 3243 154 A1 5/1984
EP 1 264 553 A1 12/2002

* cited by examiner

*Primary Examiner*—Jack W. Lavinder
(74) *Attorney, Agent, or Firm*—Buchanan Ingersoll & Rooney PC

(57) ABSTRACT

A magnetic fastener including a first detachable fastening member and a second detachable fastening member, said first and said second detachable fastening members respectively include a first and a second magnetic coupling surfaces which are magnetically attracted towards each other along an axial magnetic coupling direction, said magnetic fastener including guarding means adapted to resist relative lateral movements between said first and said second magnetic coupling surfaces when said first and said second fastening members are under magnetic coupling, said first and second fastening members include co-operative catching means adapted to resist disengagement of said first and second fastening members generally along said axial magnetic coupling direction when said first and second fastening members are simultaneously under magnetically coupling and subject to lateral tensions applied transversally to said axial magnetic coupling direction.

5 Claims, 19 Drawing Sheets

61
63
69

69
61
66
63
66

72
74
70
73
71

65
67
67
67
62

62
60
64
67

N
51
S 991
91
99
98
93

98
93
99

231
233
230
241
244
243

231
233
2391

240
244
243

232
234

250

234

250

210
244
231
232
234
2391

260

FIG. 8A - 2
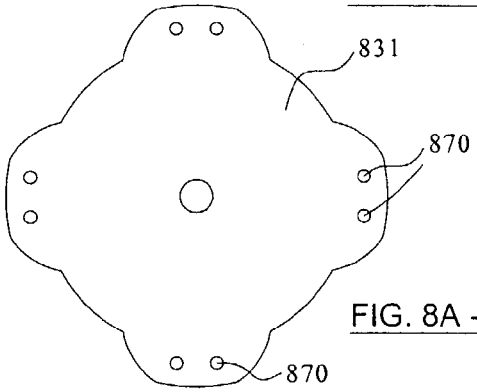
FIG. 8A - 1
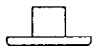
FIG. 8A - 4
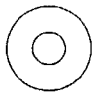
FIG. 8A - 3
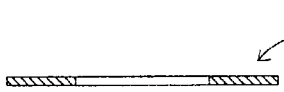
FIG. 8A - 6
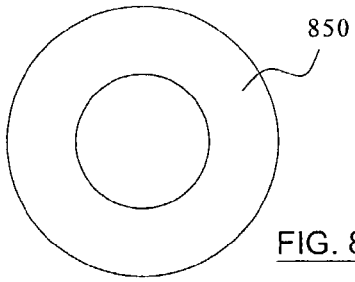
FIG. 8A - 5
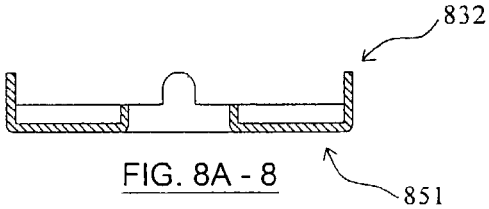
FIG. 8A - 8
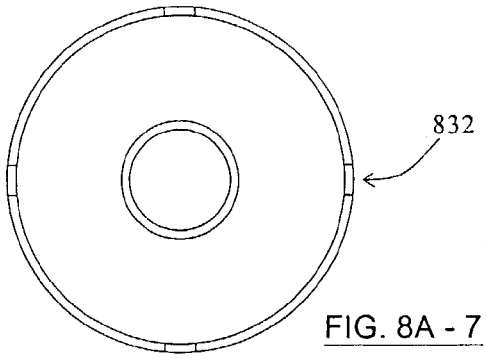
FIG. 8A - 7
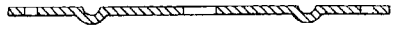
FIG. 8A - 9
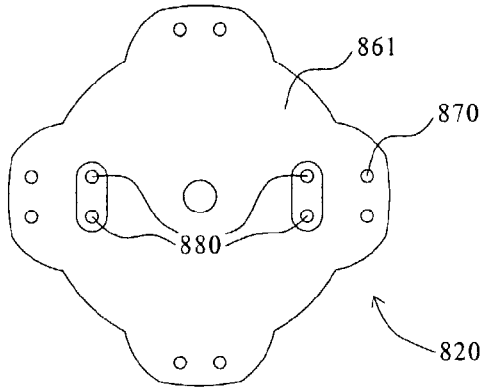
FIG. 8A - 10
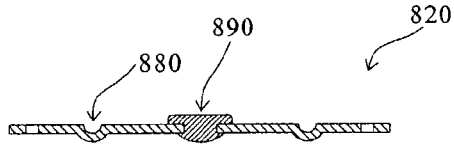
FIG. 8A - 11
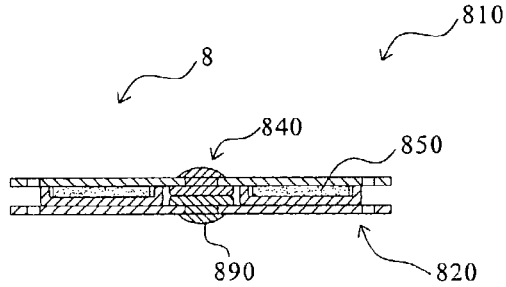
FIG. 8

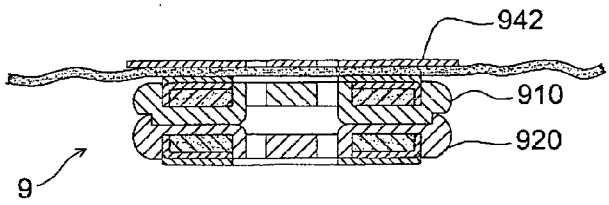
FIG. 9
FIG. 9A - 3
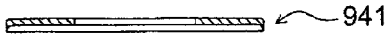
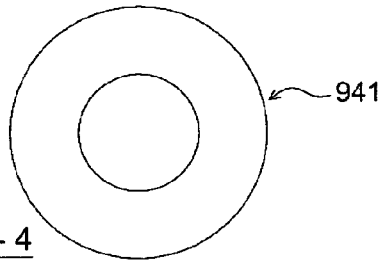
FIG. 9A - 4
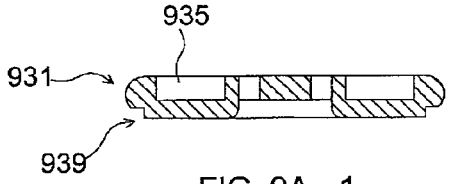
FIG. 9A - 1
932
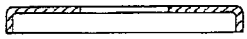
FIG. 9A - 5
932
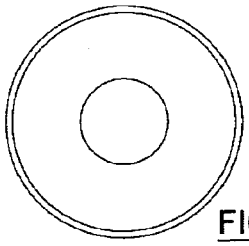
FIG. 9A - 6
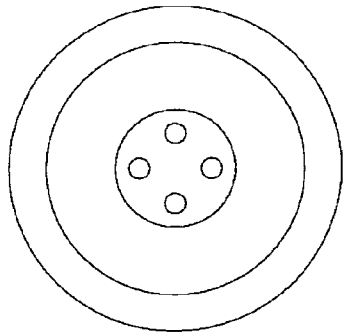
FIG. 9A - 2
950
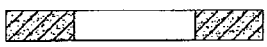
FIG. 9A - 7
950
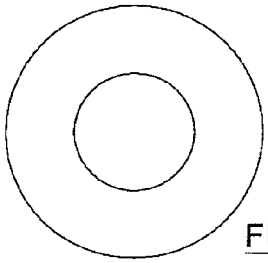
FIG. 9A - 8
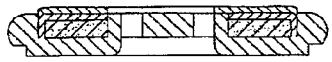
FIG. 9A FIG. 10A - 2
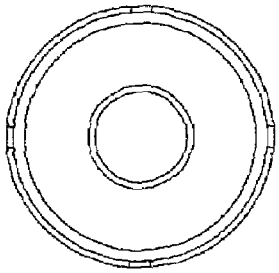
FIG. 10A - 1
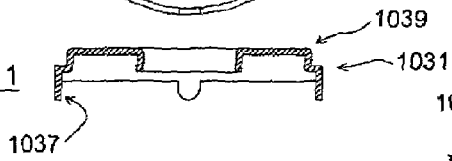
FIG. 10A - 4
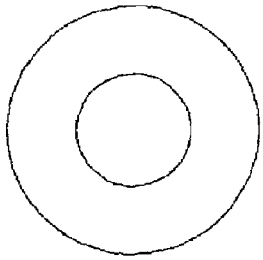
FIG. 10A - 3
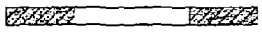
FIG. 10A - 6
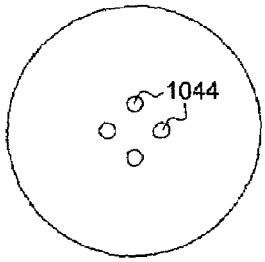
FIG. 10A - 5
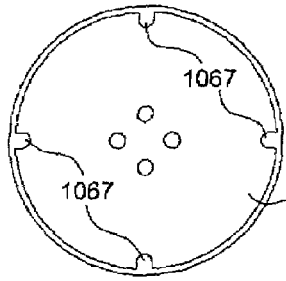
FIG. 10A - 7
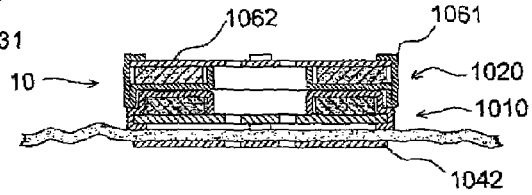
FIG. 10
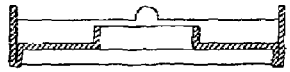
FIG. 10B - 1
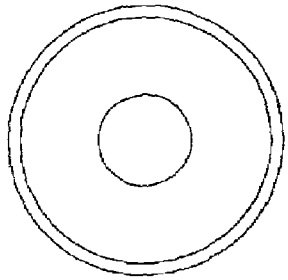
FIG. 10B - 2

MAGNETIC FASTENER

FIELD OF THE INVENTION

The present invention relates to magnetic fasteners and, more particularly, to magnetic fasteners including a pair of counterpart fasteners of complementary magnetic properties. Yet more particularly, this invention relates to magnetic fasteners with means to withstand disengaging tensions applied in more than one directions. More specifically, although of course not solely limited thereto, this invention relates to magnetic fasteners for use on apparels such as jeans and clothes.

BACKGROUND OF THE INVENTION

Magnetic fasteners have been widely used in many consumer and domestic applications for a long time. For example, magnetic fasteners have been used on clothings and apparel as well as accessories such as handbags and brief cases. In addition, magnetic fasteners are also used in domestic appliances such as refrigerator or doors for closure. With strong and compact permanent magnets, for example, tablet-shaped magnets of above 1,200 Gauss, become available at lower costs, magnetic fasteners are becoming even more popular.

Magnetic fasteners are generally considered to be advantageous to conventional fasteners such as buttons because of the convenience they offer. For example, clothing articles or apparel with a pair of counterpart magnetic fasteners mounted on the corresponding flexible parts of the articles can be easily opened and closed. The flexible parts of the articles can be easily closed because, once the corresponding counterpart magnetic fasteners are in mutual proximity, mutual magnetic attraction will bring the counterpart magnetic fasteners together and effect the well known snap-fastening closure.

However, an immediate adverse consequence of such easiness in closure is the possible risk of inadvertent or accidental disengagement between the counterpart pair of magnetic fasteners which can cause embarrassment in some cases and loss of property in others. In addition, conventional magnetic fasteners are typically capable of resisting disengaging tension along a single axis, for example, along or transversal to the magnetic coupling axis. Thus, fastening and un-fastening of counterpart magnetic fasteners are generally done along the common magnetic axis between the two counterpart permanent magnets. However, this simplistic tension resistance may not be adequate for some applications. Hence, it will be highly desirable if there can be provide improved magnetic fasteners which alleviate shortcomings of conventional magnetic fasteners. More specifically, the improved magnetic fasteners should offer the same or similar convenient level as do conventional magnetic fasteners while alleviating the undesirable risks of undesirable and inadvertent risk of disengagement between counterpart magnetic fasteners. Furthermore, it will be highly desirable if there can be provided improved magnetic fasteners which can resist disengaging tension along more than one directions while providing the convenience offered by conventional magnetic fasteners.

OBJECT OF THE INVENTION

Accordingly, it is therefore a primary object of the present invention to provide improved magnetic fasteners which alleviate the shortcomings associated with conventional or known magnetic fasteners. More specifically, it is an object of the present invention to provide improved magnetic fasteners with means to alleviate the risk of undesirable or inadvertent disengagement between counterpart coupled magnetic fasteners. Another specific object of the present invention is to provide improved magnetic fasteners with means to resist disengaging tensions which tend to disengage coupling between counterpart magnetic fasteners in more than one directions. At a minimum, it is an object of the present invention to provide the public with a useful choice of magnetic fasteners.

SUMMARY OF THE INVENTION

According to the present invention, there is provided a magnetic fastener including a first detachable fastening member and a second detachable fastening member, said first and said second detachable fastening members respectively include a first and a second magnetic coupling surfaces which are magnetically attracted towards each other along an axial magnetic coupling direction, said magnetic fastener including guarding means adapted to resist relative lateral movements between said first and said second magnetic coupling surfaces when said first and said second fastening members are under magnetic coupling, said first and second fastening members include co-operative catching means adapted to resist disengagement of said first and second fastening members generally along said axial magnetic coupling direction when said first and second fastening members are simultaneously under magnetically coupling and subject to lateral tensions applied transversally to said axial magnetic coupling direction.

According to a preferred embodiment of the present invention, there is provided a magnetic fastener including a first detachable fastening member and a second detachable fastening member, said first and said second detachable fastening members respectively include a first and a second magnetic coupling surfaces which are magnetically attracted towards each other along an axial magnetic coupling direction, said magnetic fastener including guarding means adapted to resist relative lateral movements between said first and said second magnetic coupling surfaces when said first and said second fastening members are under magnetic coupling, each said first and second fastening members includes attachment means for attaching said first or said second fastening member to an article or part of an article, said attachment means of said first and second fastening members being disposed on opposite sides of said magnetic coupling surfaces.

According to a preferred embodiment of the present invention, there is provided a magnetic fastener including a ring-shaped magnet or a ring-shaped magnetic assembly and a housing on which said magnet or said magnetic assembly is held, said housing includes a plurality of sewing holes which are disposed in the region of said housing corresponding to the central aperture of said ring-shaped magnet or ring-shaped magnet assembly.

Preferably, said guarding means include a peripheral means surrounding said first and said second magnetic coupling surfaces when said first and said second detachable are being magnetically coupled with said first and said second magnetic coupling surfaces are in contiguous contact.

Preferably, said latching means includes a peripheral wall extending generally along said magnetic coupling direction and generally surrounding said first and said second magnetic coupling surfaces when said first and said second fastening members are being magnetically coupled and in contiguous contact.

Preferably, said peripheral wall being included as part of one of said detachable fastening members, said peripheral wall includes a narrowed portion which is elevated above the magnetic coupling surface of said one of said detachable fastening members, said narrowed portion being adapted to allow through passage of the magnetic coupling surface on the counterpart detachable fastening member along said magnetic coupling direction, said elevated narrowed portion of said peripheral wall generally resists through-passage of said magnetic coupling surface of said counterpart detachable fastening member when said magnetic coupling surface of said counterpart detachable fastening member is being detached from magnetic coupling along said magnetic coupling direction while being subject to a laterally applied tension.

Preferably, said first and second detachable fastening members respectively include a first and a second permanent magnets, said first and a second permanent magnets respectively include said first and second magnetic coupling surfaces which are of the opposite magnetic polarity, each said first and said second permanent magnets being received on a non-magnetic housing.

Preferably, said non-magnetic housing on which said second permanent magnet is received includes a flared base portion, said flared base portion being adapted for resisting longitudinal disengagement between said first and said second detachable fastening members while said magnetic fastener is being subject to a lateral applied tension.

Preferably, said peripheral wall is included on one of said detachable fastening member, said peripheral wall includes on its inside an inwardly extending flanging means, and the other, counterpart, detachable fastening member includes an outwardly extending flanging means.

Preferably, either or both of said inwardly and outwardly extending flanging means includes or include a substantially circumferentially extending flange portion.

Preferably, said first detachable fastening member includes a first permanent magnet and said first magnetic coupling surface being formed on said first permanent magnet, said peripheral wall is included on said first detachable fastening member and the aperture defined by said peripheral wall exceeds the surface area of said first magnetic coupling surface.

Preferably, each said first and said second detachable fastening members includes a non-magnetic housing which respectively surrounds said first and said second magnetic coupling surfaces.

Preferably, said first detachable fastening member includes a first permanent magnet, the magnetic axis of said first permanent magnet being generally parallel to said first magnetic coupling direction, said peripheral wall generally extends away from said first magnetic coupling surface, along said magnetic coupling direction, and surrounds said first magnetic coupling surface, a circumferential ring portion is disposed intermediate of said first magnetic coupling surface and said peripheral wall.

Preferably, said peripheral wall includes a narrowed aperture at an elevation above said first magnetic coupling surface.

Preferably, said circumferential ring portion being substantially non-magnetic.

Preferably, said guarding means include means for guiding progressive coupling between said fist and said second magnetic coupling surfaces generally along said magnetic direction.

Preferably, each said first and second fastening members includes attachment means for attaching said first or said second fastening member to an article or part of an article, said attachment means of said first and second fastening members being disposed on opposite sides of said magnetic coupling surfaces.

Preferably, said first and second detachable fastening members respectively includes a first and a second permanent magnets, each said first and said second permanent magnet being embraced by a non-magnetic housing.

Preferably, each said permanent magnet being embraced by a magnetic housing, said non-magnetic housing being embraced by a non-magnetic housing.

Preferably, attachment means for attaching said detachable fastening member to an article or part of an article being formed on said non-magnetic housing, said attachment means for said first and said second detachable fastening members being formed on opposite sides of said magnetic coupling surfaces.

Preferably, said attachment means being disposed along said magnetic coupling direction.

Preferably, both said attachment means being adapted to withstand tensions applied both along and transversal to said magnetic coupling direction.

Preferably, said attachment means includes a stem portion and a cap portion, said stem portion generally extending longitudinally away from the magnetic coupling surface of said detachable fastening member and said cap generally extending transversally to said magnetic coupling direction.

Preferably, said first and said second detachable fastening member includes a non-magnetic housing surrounding the respective magnetic coupling surface, said attachment means being supported from said non-magnetic housing.

Preferably, said detachable fastening means being attached to an article or part of an article by insertion of said stem portion through said article or part of article and by retention of said article or part of said article between said cap portion and said non-housing.

Preferably, said fastener further including a ring-shaped magnet or a ring-shaped magnetic assembly and a housing on which said magnet or said magnetic assembly is held, said housing includes a plurality of sewing holes which are disposed in the region of said housing corresponding to the central aperture of said ring-shaped magnet or ring-shaped magnet assembly.

BRIEF DESCRIPTION OF THE DRAWINGS

Preferred embodiments of the magnetic fasteners of the present invention may be explained in further detail below by way of example and with reference to the accompanying drawings, in which:

FIGS. 1A-1 to 1A-7 show the various corresponding views of the constituting components, FIGS. 1B and 1B-0 respectively show the cross-sectional and bottom plan views of the second fastening part of the counterpart magnetic fasteners, FIGS. 1B-1 to 1B-8 show the various corresponding views of the constituting components, FIG. 2 shows the longitudinal cross-sectional view of a second preferred embodiment of a pair of counterpart magnetic fasteners of the present invention, FIG. 2A shows the longitudinal cross-section of the first fastening part 210 of FIG. 2, FIGS. 2A-1 to 2A-8 and FIGS. 2B-1 to 2B-8 show the various corresponding views of the components of the counterpart magnetic fasteners of the embodiment of FIG. 2, FIG. 3 shows the longitudinal cross-sectional view of a pair of counterpart magnetic fasteners of a third preferred embodiment of the present invention, FIG. 4 shows the longitudinal cross-sectional view of a pair of counterpart magnetic fasteners of a fourth preferred embodiment of the present invention with the attachment means separated, FIGS. 6 and 6A show a sixth preferred embodiment of the present invention and its variation, FIGS. 7 and 7A show a seventh preferred embodiment of the present invention and FIG. 7B shows its variation, FIGS. 7A-1 and 7A-2 show the cross-sectional views of the housing of the component of FIG. 7A, FIGS. 7B-1 and 7B-2 respectively show the top plan and cross-sectional view of the housing of the component fastener of FIG. 7B, FIG. 8 shows an eighth preferred embodiment of the present invention and FIGS. 8A-1 to 8A-11 show the various views of its component parts, FIGS. 9 and 9A to 9C show the cross-sectional view of a pair of magnetic fasteners of a ninth preferred embodiment of the present invention and the corresponding cross-sectional views of the fastening parts and their exploded views, FIGS. 9A-1 to 9A-8 and FIGS. 9B-1 to 9B-4 show the various views of the component parts, FIG. 10 shows the cross-sectional view of a pair of magnetic fasteners of a tenth preferred embodiment of the present invention and FIGS. 10A-1 to 10A-7 and FIGS. 10B-1 to 10B-2 show the various corresponding views of the component parts.

DETAILED DESCRIPTION OF THE PREFERRED EMBODIMENTS

Figure 1:
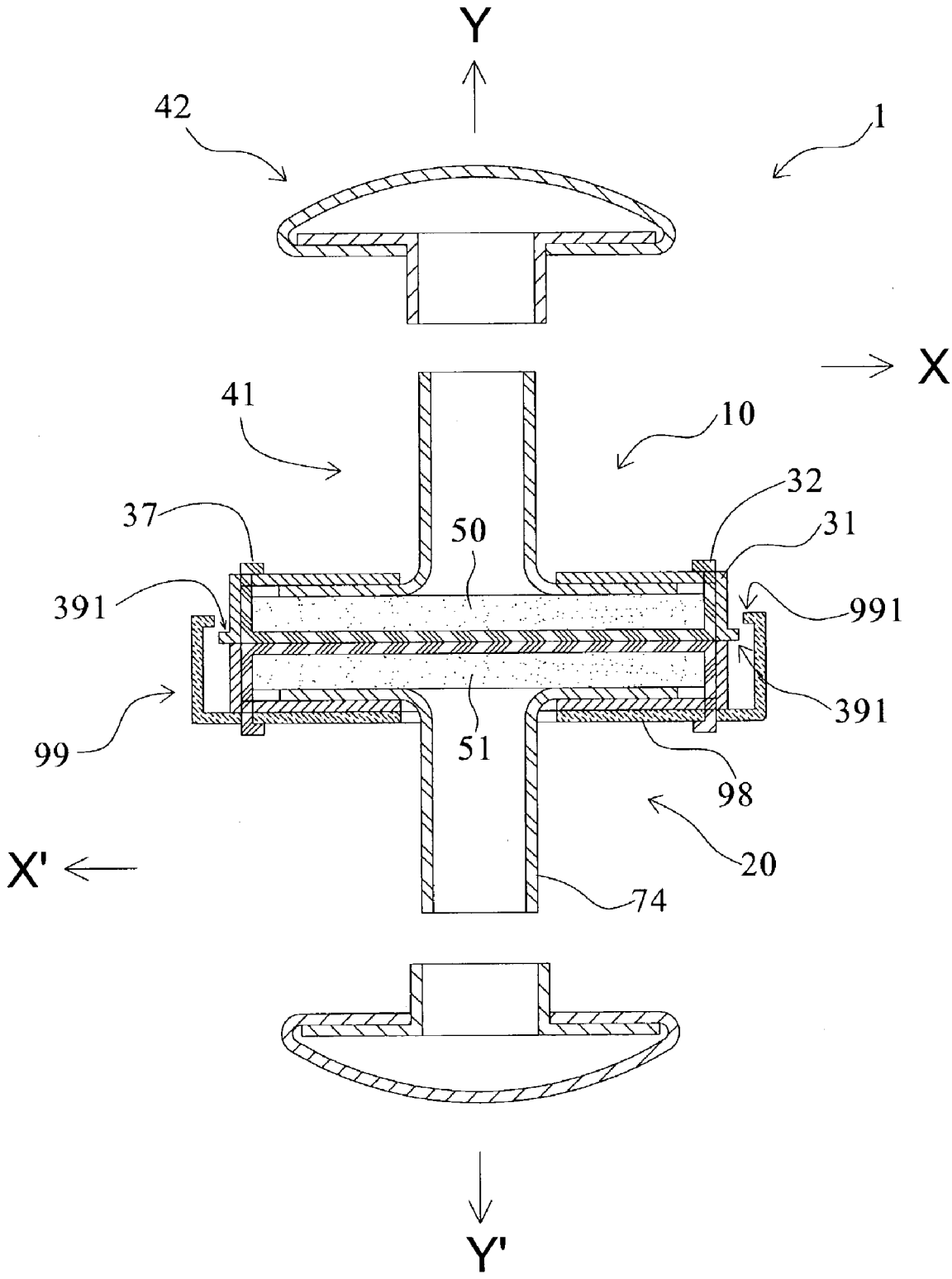
FIG. 1 is a longitudinal cross-sectional view of a pair of counterpart magnetic fasteners of a first preferred embodiment of the present invention with the attachment means separated, FIGS. 1A and 1A-0 respectively show the cross-sectional and bottom plan views of the first fastening part of the counterpart magnetic fasteners.
Figure 1A:
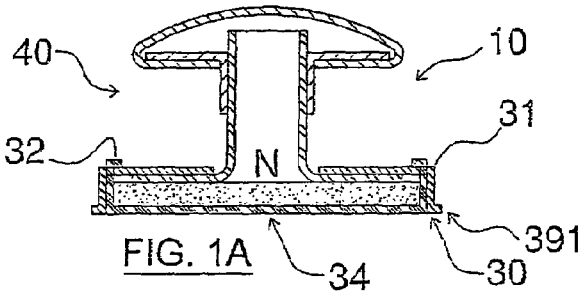
Figures 0, 1A:
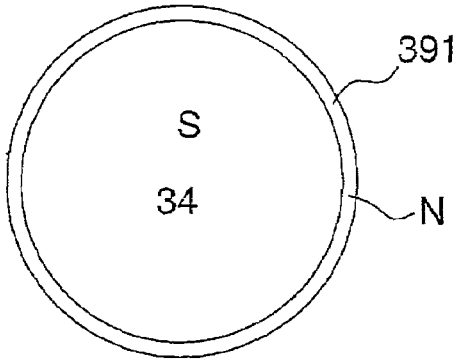
Figures 0, 1B:
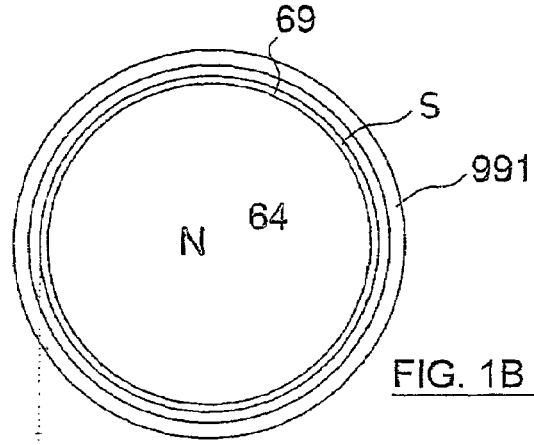
Figure 1B:
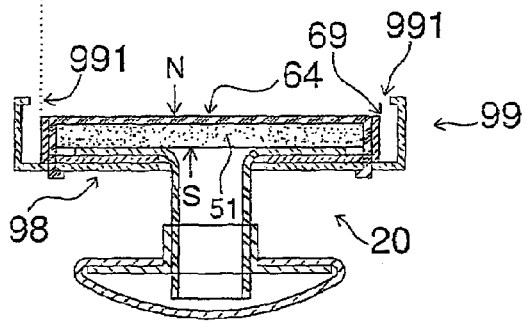

Referring firstly to FIGS. 1, 1A-0 to 1A-7, 1B-0 to 1B-8 and FIG. 1C, there are shown a first preferred embodiment of the present invention of a magnetic fastener 1. The magnetic fastener 1 includes a first fastening part 10 and a second fastening part 20. The first fastening part 10 includes a main housing 30 and an attachment means 40. The main housing 30 includes a first 31 and a second 32 housing parts which are assembled together for receiving a permanent magnet 50. The attachment means 40 includes a stem portion 41 and a cap portion 42. The stem portion 41 is provided with a widened bottom end 43 so that the attachment means 40 can be retained by the main housing 30 with the widened portion 43 kept within the main housing and the elongated neck of the stem portion 41 protruding through a correspondingly shaped aperture 33 formed on the top surface of the first housing part 31 of the main housing 30. The transition from the neck portion 44 to the shoulder portion 43 can be gradual, e.g. flared, or abrupt as in the present example.

The second housing part 32 includes a magnetically permeable first magnetic coupling surface 34 and a receptacle 35 for receiving the permanent magnet 50. This second housing part can be made of, for example, chromium or nickel plated stainless steel which are generally magnetic in nature. The first housing part 31 includes a top portion 38 with a downwardly dependent and circumferentially extending skirt 39. An outwardly extending flange 391 is formed circumferentially on the lower end of the skirt 39. A plurality of apertures 36 is formed on the top portion 38 for coupling with the second housing part 32 via a plurality of upstanding fingers 37 which are distributed on the second housing part. The fingers 37 in the second housing part 32 extend from the coupling surface 34 and are distributed corresponding to the spatial locations of the apertures 36.

To assemble the first fastening part 10, a tablet-shaped permanent magnet 50 is inserted into the receptacle 35 with one of the magnetic polar surfaces (say the "S" pole) resting adjacent the magnetic permeable first magnetic coupling surface 34. The upwardly protruding fingers 37 on the second housing part 32 are then aligned with the apertures 36 on the first housing part 31 with the stem portion 41 having been first assembled with the first housing part 31 so that the elongated neck portion 44 is protruding above the top portion 38 while the shoulder portion 43 is being retained underneath the aperture 33 and the top portion 38. With the permanent magnet 50 and the stem portion 41 inserted in place, the first 31 and the second 32 housing parts are then assembled together. This is done, for example, by pressing the first 31 and the second 32 housing parts together and then by clamping the two housing parts together by bending the upwardly extending fingers 37 so that the permanent magnet tablet 50 is tightly received within the receptacle 35. The bottom surface of this circumferential flange 391 is generally levelled with the first magnetic coupling surface 34 when assembled. A magnetic sub-assembly 50*a* comprising a ring-shaped permanent magnet and a magnetic base with a central protrusion can be used to replace the magnet 50.

To complete assembly of the first fastening part 10, the cap portion 42 is joined to the top end of the neck portion 44. In preferred applications, the neck portion 44 is usually received through an aperture or button-hole formed on the surface of the article to be attached before the cap portion 42 is fixed onto the sub-assembly comprising the permanent magnet 50, the main housing 30 and the stem portion 41. As an alternative, the sub-assembly can be riveted on the article by deforming, for example, by stamping the top end of the neck portion 44, to form a widened top end of the neck portion 44 so that fastening part is retained on the article.

The first housing part 31 is also made of a magnetic material, for example, chromium or nickel-plated stainless steel so that the magnetic field emanating from the back polar surface (say the "N" pole in this example) of the permanent magnet tablet 50 can be redirected and concentrated along the circumferential flange 391 for enhanced magnetic coupling with the counterpart fastener 20. Of course and, without loss of generality, the first housing part 31 and the second housing part 32 can be made of non-magnetic material such as cooper or brass.

Referring to FIGS. 1B, and 1B-0 to 1B-8 showing the second magnetic fastening part 20, the fastening part 20 includes a main housing 60, an attachment means 70 and a permanent magnet tablet 51. The attachment means 70 includes a stem portion 71 and a cap portion 72 which are generally and respectively similar to the cap portion 41 and stem portion 42 of the first fastening part 10 and serve similar purposes. The main housing 60 includes a first housing part 61, a second housing part 62 and a third housing part 91. The first 61 and the second 62 housing parts are connected together via corresponding pairs of apertures 66 and protruding fingers 67 distributed respectively on the first 61 and the second 62 housing parts. In general, the first 61 and the second 62 housing parts of this second magnetic fastening part 20 are generally similar to the corresponding parts of the first fastening part 10 and generally serve the same purposes. This sub-assembly comprising the first 61 and the second 62 housing parts are then mounted onto the third housing part 91. The third housing part 91 includes a base portion 98 formed with an aperture 93 through which the elongated neck portion 74 of the attachment means 70 can pass through. An upwardly extending skirt portion 99 for surrounding the sub-assembly comprising the first 61 and the second 62 housing parts is dependently formed from the base portion 98. It will be noted that this skirt portion will serve as a guarding means to resist lateral displacement of the first and the second magnetic coupling surfaces. An inwardly extending flange 991 is formed on the upper end of the skirt portion 99.

In assembling this second fastening part 20, the permanent magnetic tablet 51 is placed within the receptacle 65 with the magnetic polar surface (say "N" in this example) of the permanent magnet 51, which is complementary to the magnetic polar surface ("S") of the permanent magnet tablet 50 adjacent to the surface 34, placed adjacent to the second magnetic coupling surface 64, for magnetic attraction.

Similarly, the stem portion 71 of the attachment means 70 includes an elongated neck portion 74 and a shoulder portion 73. The neck portion 74 is dimensioned so that it can pass through the aperture 63 of the first housing part 61 while the shoulder portion 73 will be blocked by the aperture 63. Before the first housing part 61 and the second housing part 62 are assembled together, it will be noted that the stem portion 71 of the attachment means 70 has been inserted through the aperture 63 so that the permanent magnet table 51 is retained between the second magnetic coupling surface 64 and the shoulder portion 73. This semi-sub-assembly comprising the first 61, second 62 housing parts, the stem portion 71 and the permanent magnet tablet 51 are then mounted onto the base portion 98 of the third housing part 91 with the neck portion 74 protruding through the apertures 63 and 93. This semi-sub-assembly is mounted onto the third housing part 91 with the second magnetic coupling surface 64 facing the aperture defined by the skirting portion 99.

The first 61 and the second 62 housing parts are also made of a magnetic material such as chromium or nickel plated stainless steel. With a magnetic permeable housing, magnetic flux can be permeable through the surface 64 for magnetic coupling with the counterpart fastener 10. In addition, the magnetic flux emanating from the back polar surface of the permanent magnet 51, i.e. the polar surface not resting against the second magnetic coupling surface 64 to appear along the circumferential rim 69, the circumferential rim 69 will be redirected and concentrated on the first housing part 61 as the first housing part 61 substantially forms a magnetic basin, thereby enhancing the magnetic field strength and strengthening the magnetic coupling between the two fastening parts 10, 20. Furthermore, it will be noted that the circumferentially and inwardly extending flange 991 is elevated above the second magnetic coupling surface 64 and is high enough to surround the circumferential flange 391 of the first fastening part 10 to form the guarding means when the first and the second parts are coupled together.

Turning now to the operation of the fastener 1 and referring again to FIG. 1, because the permanent magnet tablets 50 and 51 are disposed so that the magnetic polar surfaces of opposite polarities are adjacent the corresponding first and second magnetic coupling surfaces 34 and 64, the counterpart magnetic fastening parts 10 and 20 will be attracted by the opposite magnetic poles between the first magnetic coupling surface 34 and the second magnetic coupling surface 64. Furthermore, as additional complementary magnetic fields are generally concentrated respectively along the circumferential flange 391 and the circumferential rim 69, which are substantially correspondingly shaped, the counterpart fastening parts will be coupled with additional cohesive force and with substantially automatic alignment without requiring extra efforts to align the two counterpart fastening parts.

Specifically, when the fastener parts 10 and 20 are in mutual proximity, the permanent magnets 50 and 51 will be mutually attracted along a magnetic coupling axial direction Y–Y' which is generally parallel to the longitudinal direction of the neck portions of the counterpart fastener parts 10, 20. Furthermore and, as more particularly shown in FIG. 1, when the pair of counterpart magnetic fasteners 10, 20 are subject to a lateral sheering or disengaging tension along X–X'. as shown in FIG. 1, for example, as in the case of application on jeans or other apparel, the lateral tension will cause relative displacement of the fastening parts along the first 34 and the second 64 magnetic coupling surfaces so that the circumferential flange 391 will be moved to be located intermediate the circumferential flange 991 and the base portion 98 of the said housing part 91. When this happens, the pair of magnetic fasteners will also be resistive to axial or longitudinal disengaging tension along Y–Y' since the circumferential flanges 991 and 391 will co-operatively form a catching means for resisting the longitudinal disengaging movement of the circumferential flange 391 to provide additional resistance to disengagement along the axial direction when subject to the lateral tension.

Referring now to FIGS. 2, 2A, 2A-1 to 2A-8 and 2B-1 to 2B-8 showing a second preferred embodiment of the present invention of a magnetic fastener 2, the magnetic fastener 2 includes a first fastening part 210 and a second fastening part 220. The first fastening part 210 includes a main housing 230 and an attachment means 240. The main housing 230 includes a first 231 and a second 232 housing parts which are assembled together for receiving a permanent magnet 250. The first 231 and the second 232 housing parts are substantially identical to the corresponding parts of the first preferred embodiment, i.e. to housing parts 31 and 32 respectively.

The attachment means 240 includes a stem portion 241 and a base portion 243. The stem portion 241 includes a pair of upwardly extending arms 244 so that the attachment means 240 can be retained by the main housing 230 with the base portion 243 kept within the main housing and the elongated arms 244 of the stem portion 241 protruding through correspondingly shaped apertures 233 formed on the top surface of the first housing part 231 of the main housing 230.

Referring to FIGS. 2B-1 to 2B-8 showing the second magnetic fastening part 220, the fastening part 220 includes a main housing 260, an attachment means 270 and a permanent magnet tablet 251. The attachment means 270 includes a stem portion 274 and a base portion 273 which are generally and respectively identical to the base portion 243 and stem portion 244 of the first fastening part 210 and serve similar purposes. The main housing 260 includes a first housing part 261, a second housing part 262 and a third housing part 291 and are substantially identical to that (60) of the first preferred embodiment.

It will be noted from the preferred embodiments above that the magnetic fastener includes a first detachable fastening member (10, 210) and a second detachable fastening member (20, 220). Each of the first and the second detachable fastening members respectively includes a first (34, 234) and a second (64, 264) magnetic coupling surfaces which are mutually attracted towards each other along an axial magnetic coupling direction Y–Y'. In addition, the magnetic fastener includes guarding means (99, 299) which is adapted to resist relative lateral movements between the first and the second magnetic coupling surfaces when the first and the second fastening members are under magnetic coupling. In addition, the first and the second fastening members include co-operative catching means (391, 991; 2391, 2991) adapted to resist disengagement of the first and the second fastening members generally along the axial magnetic coupling direction Y–Y' when the first and the second fastening members are magnetically coupled and subject to lateral disengaging tensions X' applied transversally to the axial magnetic coupling direction.

The benefit of this magnetic fastener is particularly notable when used on jeans or other apparel in which the article will need to resist disengaging tensions in more than one directions. For example, when the pair of coupled fastening parts are subject to disengaging tension along the waist-line as well as the radial expansion of the waist, which is respectively analogous to simultaneous tensions along the lateral direction X–X' and the magnetic coupling axis Y–Y'. Furthermore, it will be noted that the attachment means for attaching the first and the second fastening members to an article or part of an article are substantially disposed on opposite sides of the magnetic coupling surfaces.

Referring to FIGS. 3, 3A-1 to 3A-2 and 3B-1 to 3B-2, there is shown a third preferred embodiment of a magnetic fastener 3 of the present invention. The magnetic fastener 3 includes a first fastening part 310 and a second fastening part 320 which are substantially identical. Each of the first 310 and the second 320 fastening parts are substantially identical to the first fastening part 10 of the first preferred embodiment with the exception of the first housing part 31 of the main housing 30. The first housing part 310, 320 of this preferred embodiment includes a top portion 338 on which an aperture 333 is formed to allow penetration of the neck portion of the attachment means. Similar to the first housing part 31 of the first preferred embodiment, a circumferential skirting is downwardly dependent from the top portion 338 which, when co-operated with the second housing part 332, will define a receptacle for receiving the permanent magnet tablet. Unlike the outwardly extending circumferential flange 391 of the first housing part 31, the downward end of the skirting 339 is formed with a catching means 3391 which downwardly extends beyond the depth of the skirting 339. This catching means 3391 is in the form of a skewed tooth so that when the first 310 and the second fastening parts are coupled together and with the teeth disposed substantially diametrically across, the totality of the teeth will resist lateral displacements of the two fastening parts along the first and the second magnetic coupling surfaces. It will be noted that the free lower end of the skirting 339 is non-symmetrical about the magnetic coupling axial direction. The first 331 housing parts 331 and 361 of the first and the second fastening parts are made of magnetic materials while the second housing parts 332 are made of copper, brass or other non-magnetic materials.

Figures 1, 1A, 2:
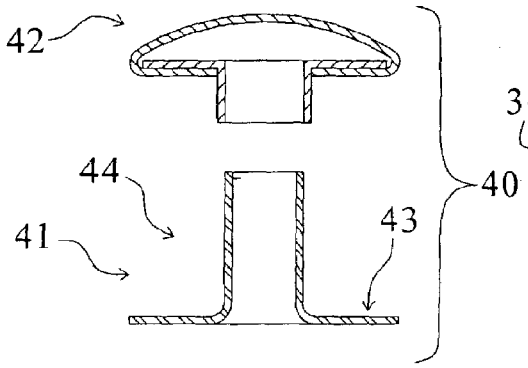
Figures 1, 1A:
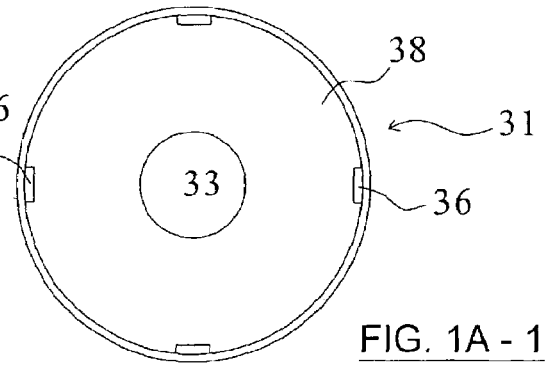
Figures 1, 1A, 2, 3:
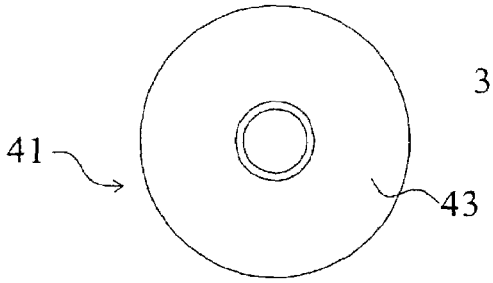
Figures 1, 1A, 2, 3, 4:
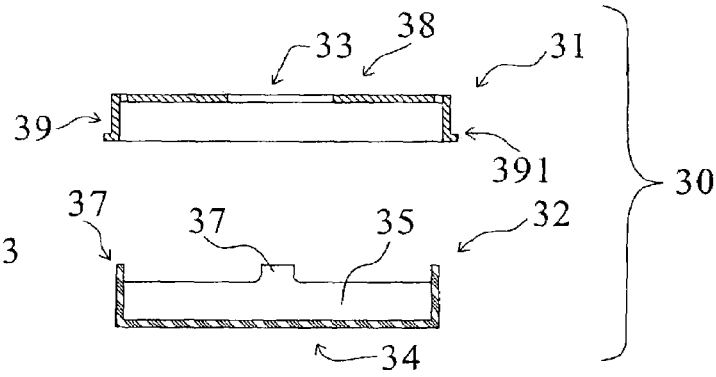
Figure 4:
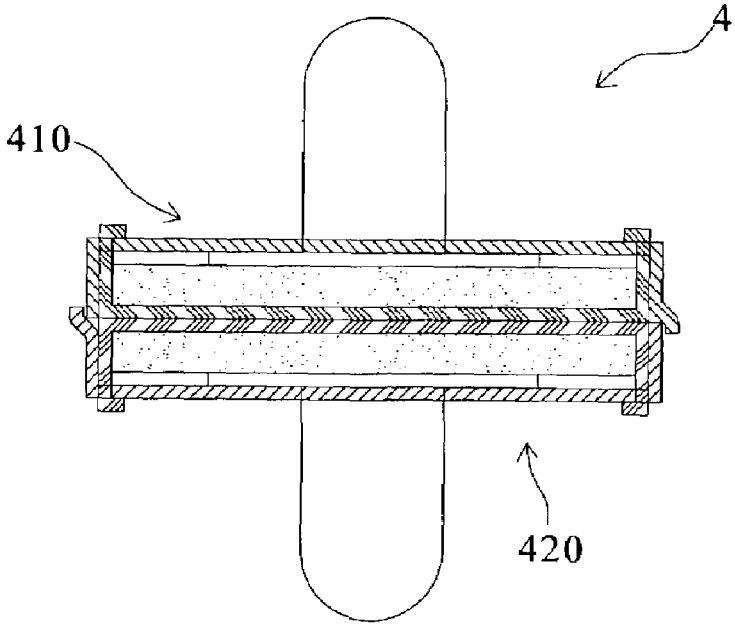
Figure 4A:
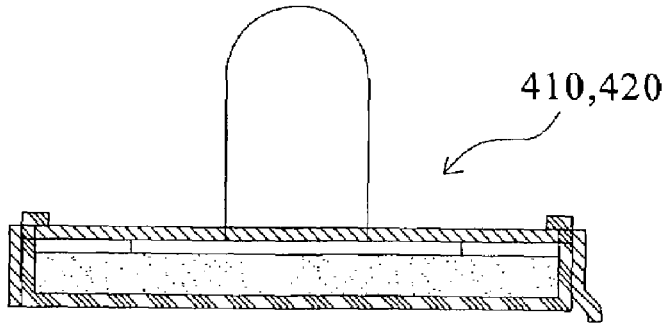
FIG. 4A shows the longitudinal cross-sectional view of one of the counterpart magnetic fastener of FIG. 4, FIGS. 5 and 5A show a fifth preferred embodiment of the present invention and its variation.
Figure 6:
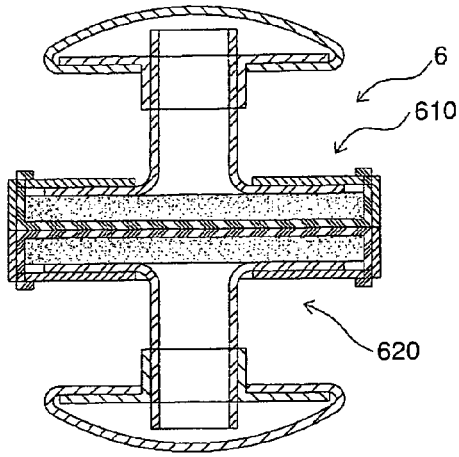

Referring to FIGS. 4 and 4A, there is shown a fourth preferred embodiment of a magnetic fastener 4 of the present invention. The magnetic fastener 4 includes a first 410 and a second 420 fastening parts which are substantially identical. Similar to the previous embodiments, each of the fastening parts 410, 420 includes a permanent magnet tablet, a main housing and attachment means. The main housing of this preferred embodiment is substantially identical to that of the third preferred embodiment while the attachment means is substantially to the attachment means 271 of the second preferred embodiment.

Figures 1, 1A, 2, 3, 4, 5, 6:
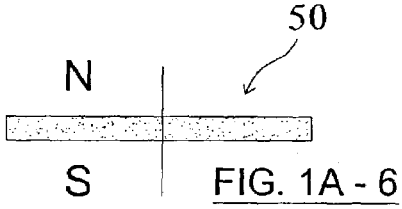
Figures 1, 1A, 2, 3, 4, 5:
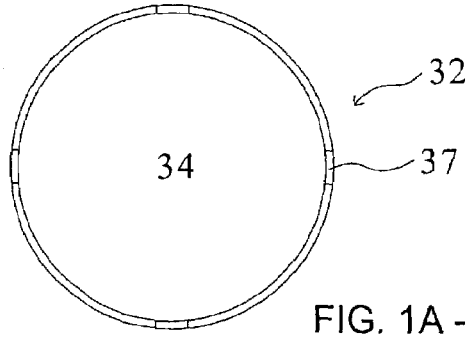
Figures 1, 1A, 2, 3, 4, 5, 6, 7:
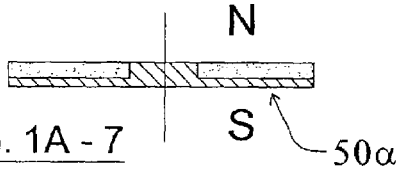
Figure 5:
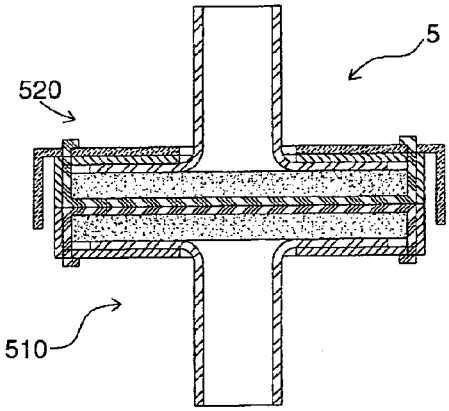
Figure 5A:
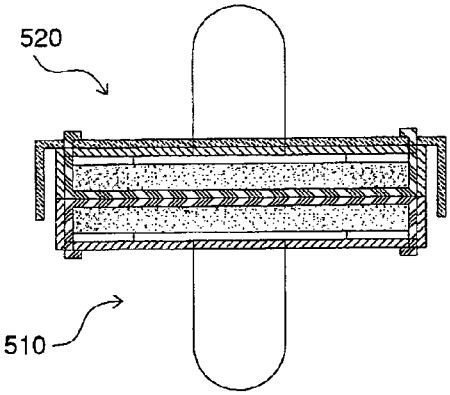

Referring to FIGS. 5 and 5A showing a fifth preferred embodiment of the present invention and its variation, the magnetic fastener 5 includes a first fastening part 510 and a second fastening part 520. The first fastening part 510 includes a main housing which is substantially identical to the main housing 30 of the first fastening part 10 of the first preferred embodiment except with the absence of the outwardly extending flange 391. The attachment means for the variation of FIG. 5 is substantially identical to that of the embodiment of FIG. 1 while that in the variation of FIG. 5A is substantially identical to the second preferred embodiment. The second fastening part 520 includes a main housing which is substantially identical to the main housing 60 of the first preferred embodiment except that the free end of the said housing part is not inwardly bend to form the flange 991.

Figure 6A:
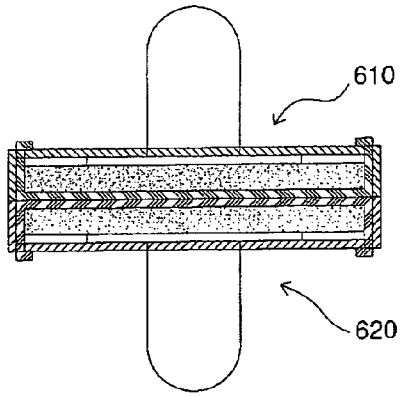

Referring to FIGS. 6 and 6A, there are shown a sixth preferred embodiment of a magnetic fastener 6 of the present invention and its variation. The magnetic fastener 6 includes a first fastening part 610 and a second fastening part 620. Each of the fastening parts 610 and 620 includes a main housing and an attachment means. The attachment means can be the same as that of FIG. 5 and FIG. 5A. The main housing is substantially identical to that of the main housing of the second fastening part 20 of the first preferred embodiment except that the third housing part 91 is not present.

Figures 2, 7B:
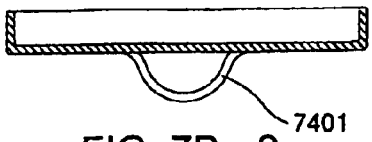
Figures 2, 7A:
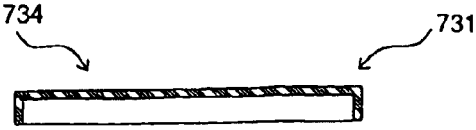
Figures 1, 7A:
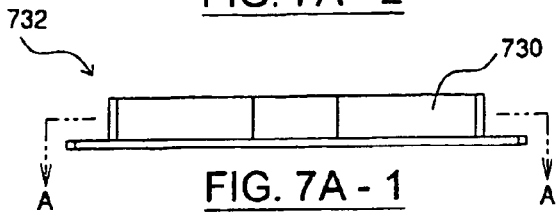
Figures 1, 7B:
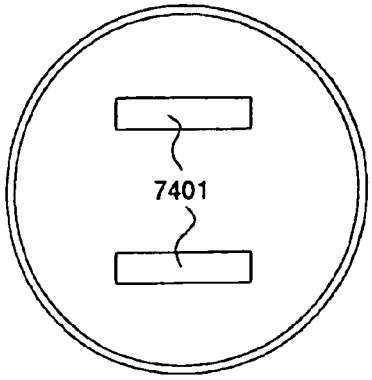
Figure 7A:
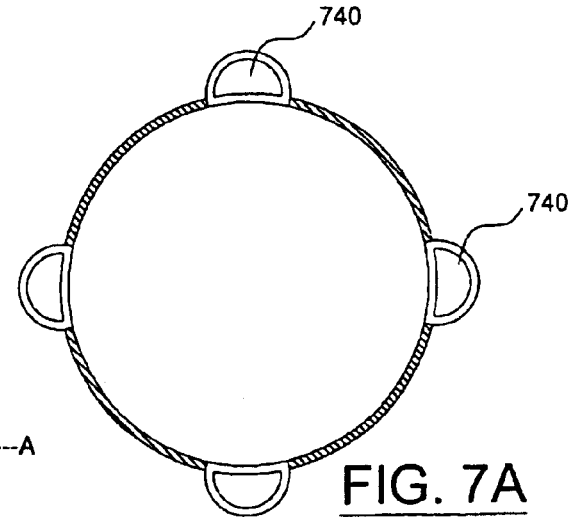
Figure 7B:
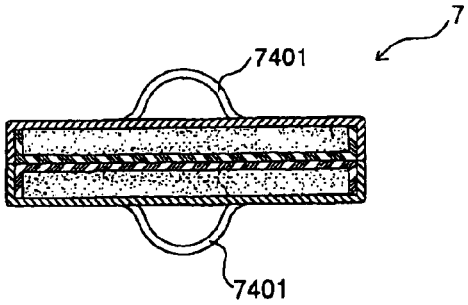
Figure 7:
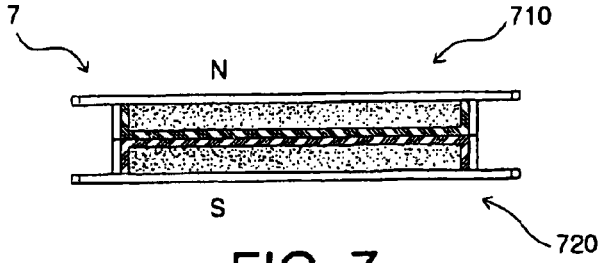
Figures 4, 9B:
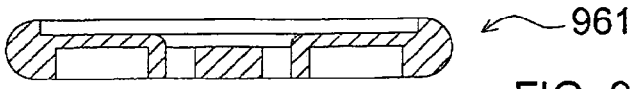
Figures 3, 9B:
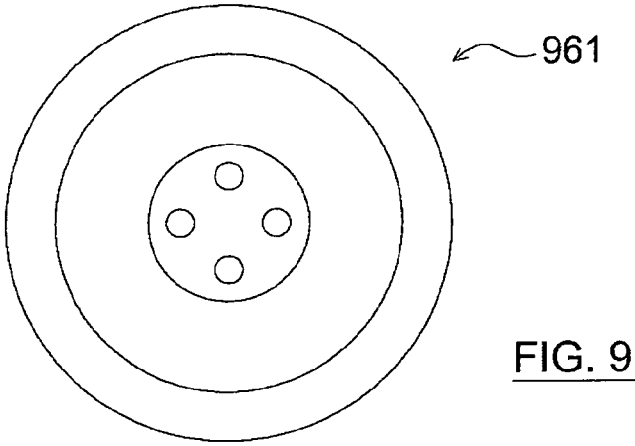
Figures 2, 9B:
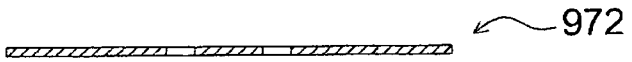
Figures 1, 9B:
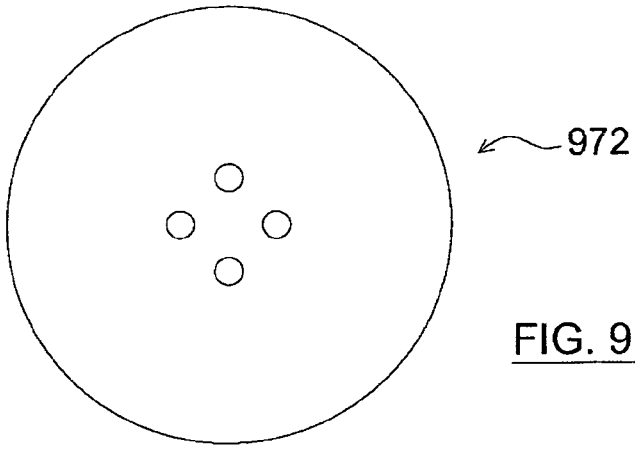
Figure 9B:
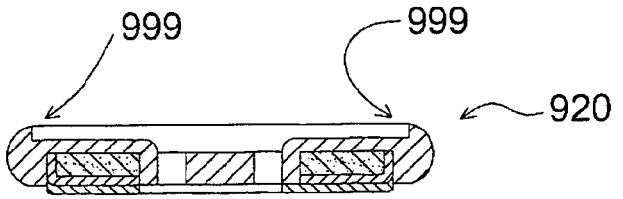
Figure 9C:
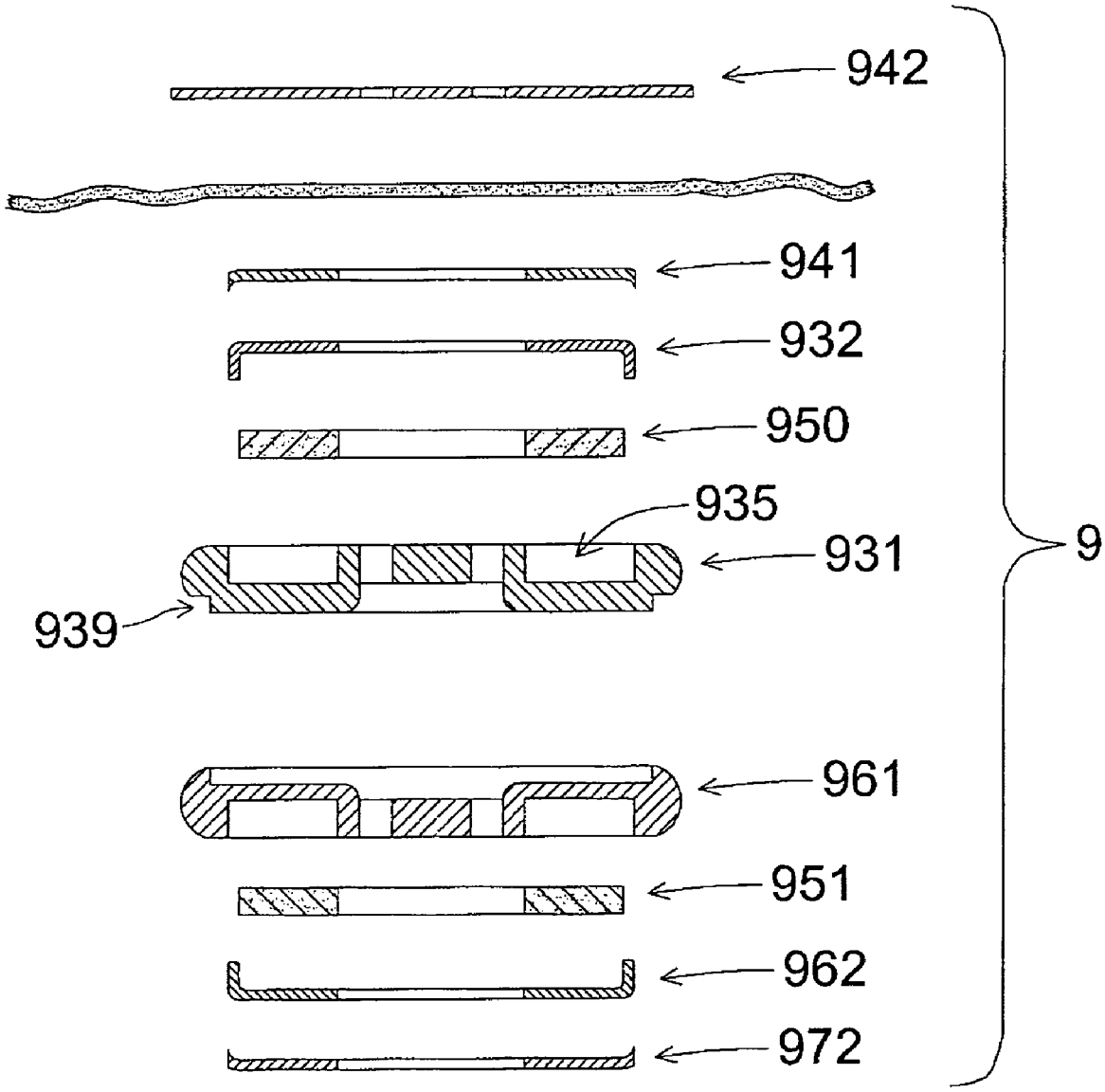

FIGS. 7, 7A and 7A-1 to 7A-2 illustrate a seventh preferred embodiment of the present invention and its variations. Similar to the other preferred embodiments, the magnetic fastener 7 includes a first and a second fastening parts and each of the fastening parts includes a main housing 730 and attachment means 740. The main housing 730 includes a first housing part 731 and a second housing part 732 which, together, define a receptacle for receiving a permanent magnet. The first housing part 731 includes a magnetic permeable surface 734 so that the magnetic flux of the polar surface of the permanent magnet immediately adjacent to the magnetic coupling surface 734 can pass through this surface for magnetic attraction. The second housing part 732 includes a circumferential wall made of a magnetic material so that the magnetic field originating from the back polar surface of the permanent magnet, that is, the polar surface not immediately adjacent to the coupling surface 734, can be redirected and concentrated along the free end of the circumferential wall of the second housing 732 to enhance magnetic attraction strength. The attachment means includes a polarity of ear-shaped members with a hollow frame so that the fastening parts 710, 720 can be sewn onto the corresponding parts of an article. The variation shown in FIGS. 7B and 7B-1 to 7B-2 is substantially identical to that of FIG. 7 except that showing attachment means 7401 are formed on the back surface of the main housing.

Figures 1, 1B, 2, 3, 4, 5, 6, 7, 8:
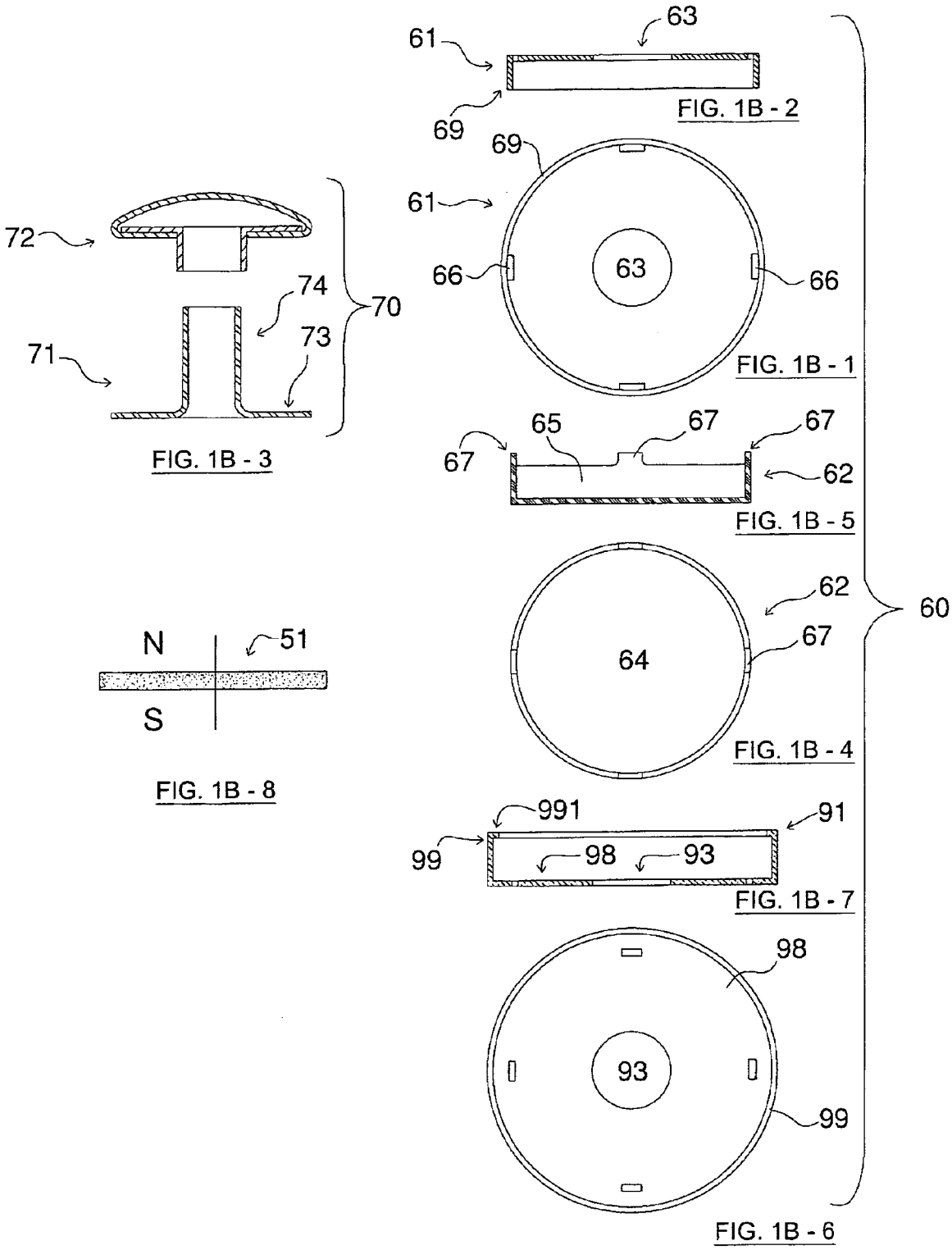
Figure 1C:
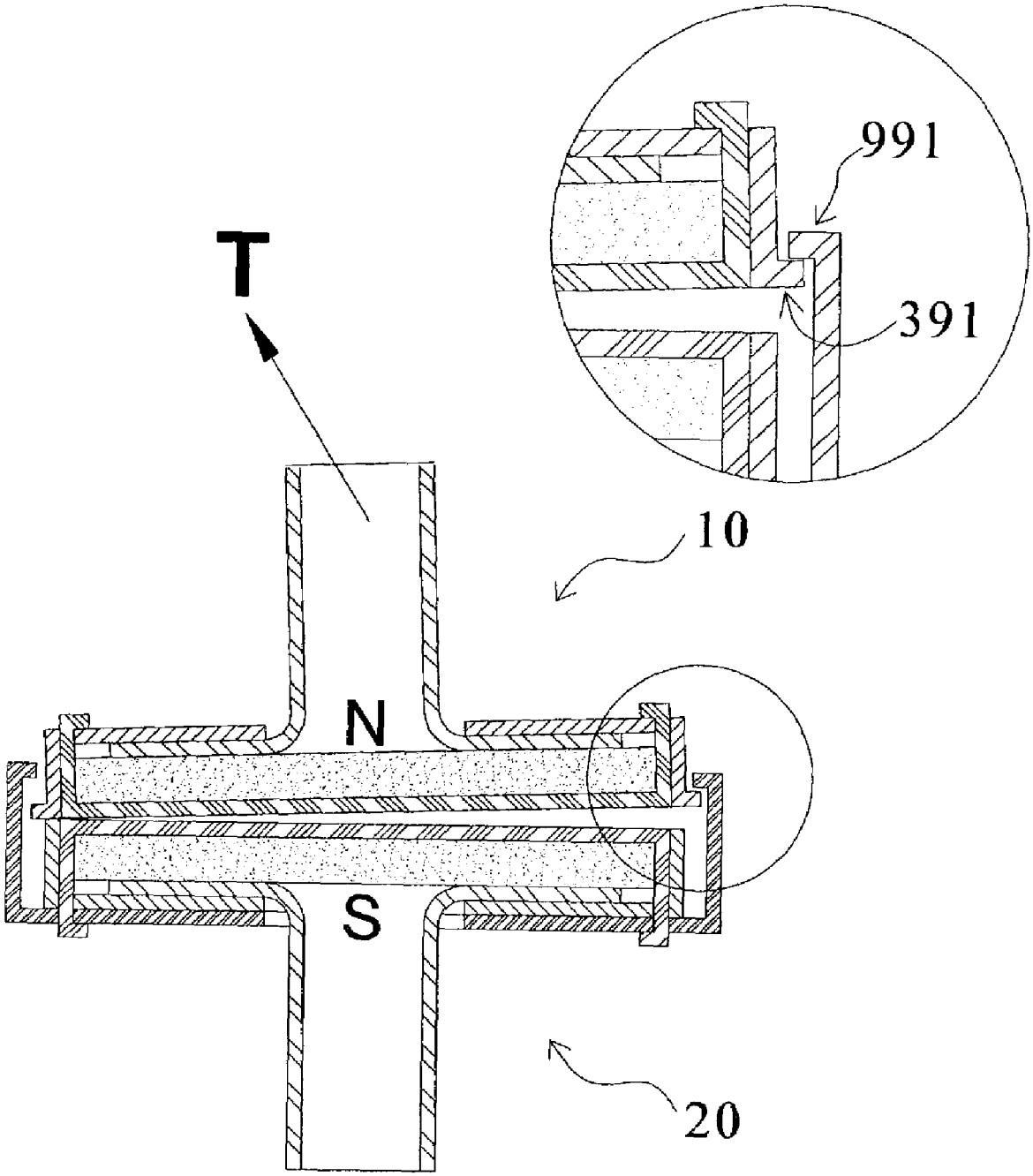
FIG. 1C shows the counterpart magnetic fastener pair of FIG. 1 when subject to a disengaging force which is non-parallel or non-orthogonal to the magnetic axis characteristic of the pair of fasteners.
Figure 2:
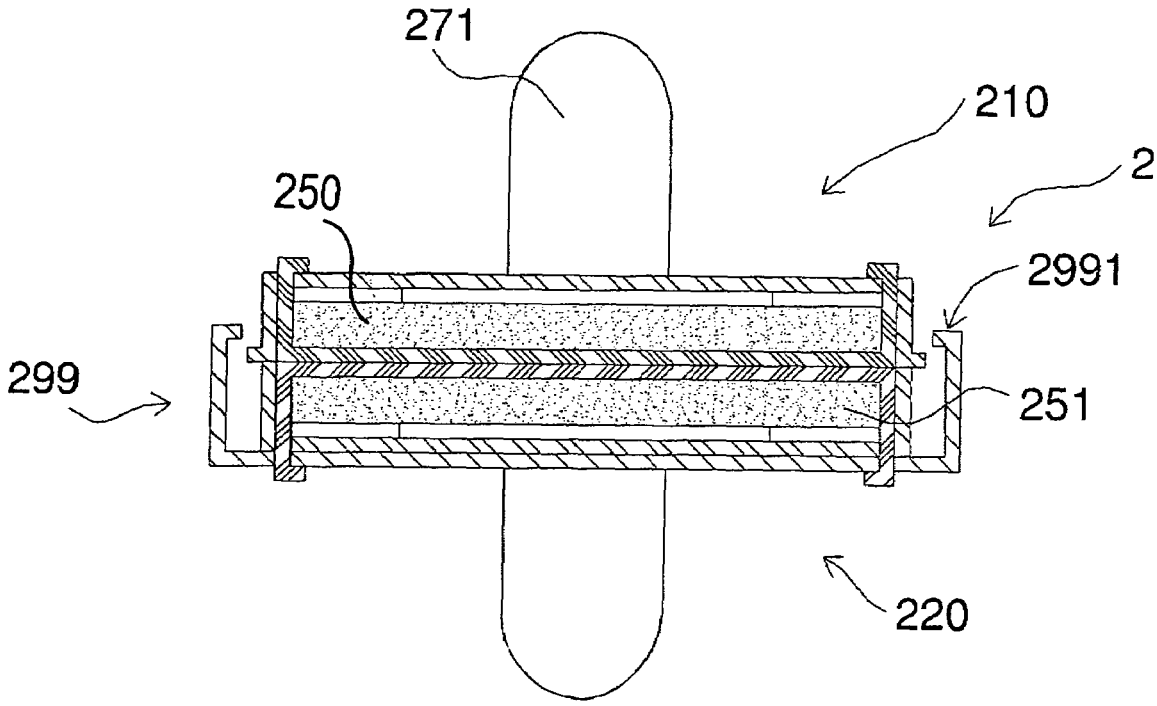
Figures 1, 2, 2A, 3, 4, 5, 6, 7, 8:
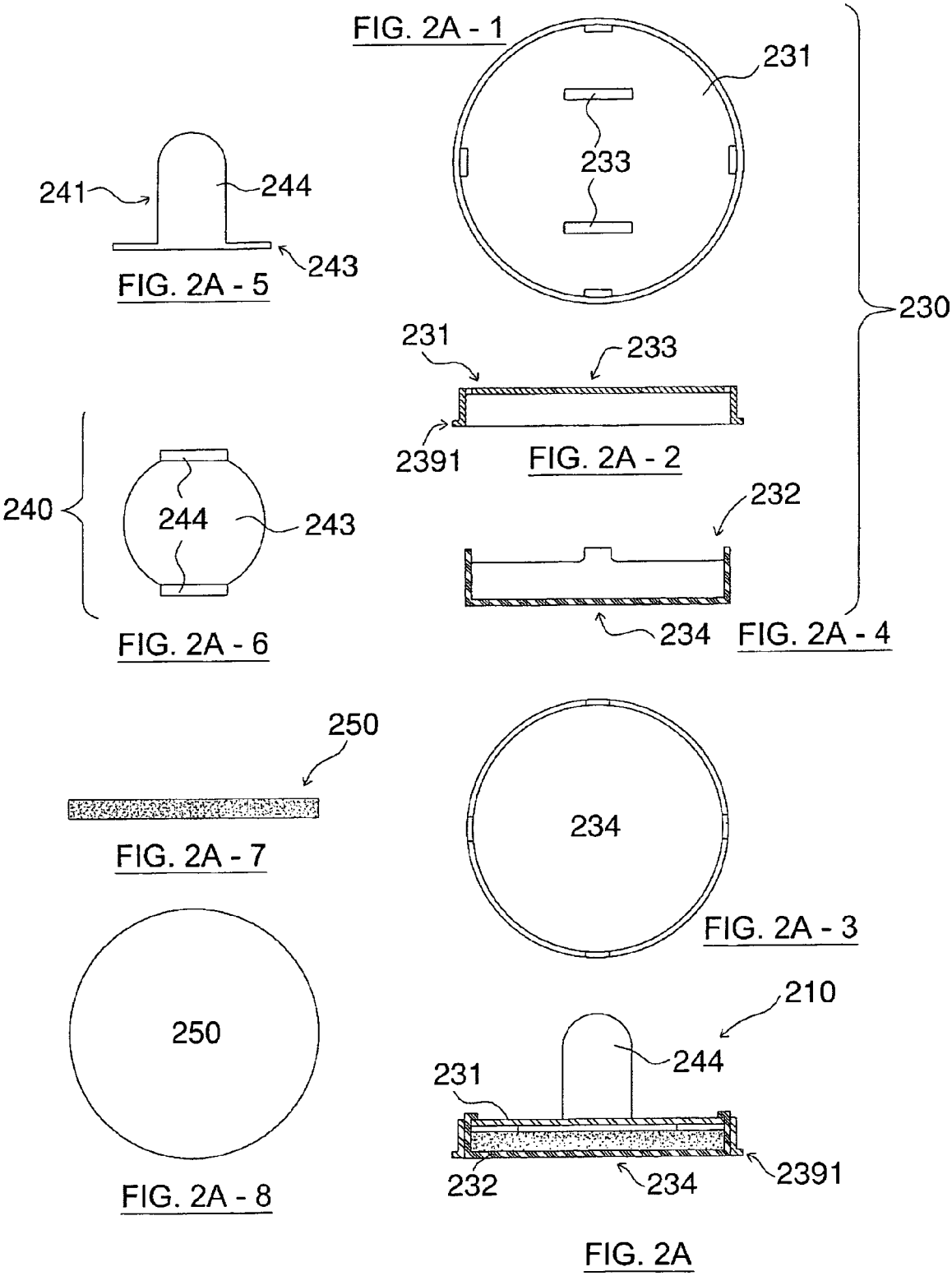
Figures 2, 2B, 3, 4, 5, 6:
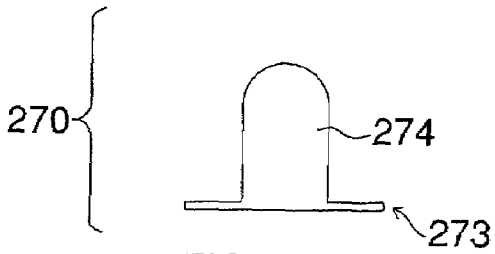
Figures 1, 2B:
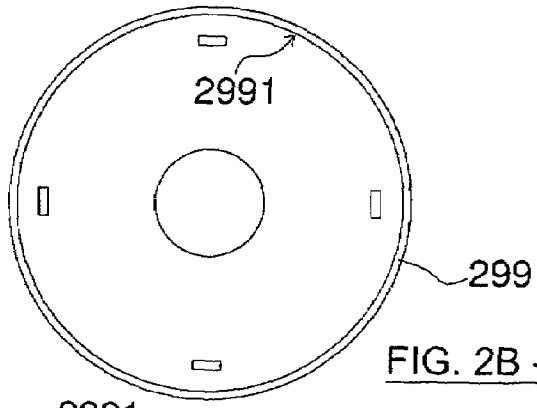
Figures 2, 2B:
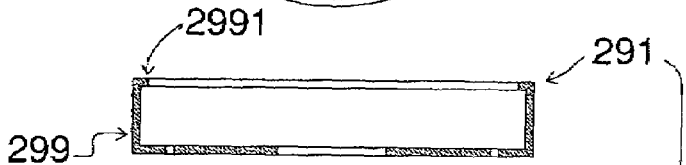
Figures 2, 2B, 3, 4, 5, 6, 7:
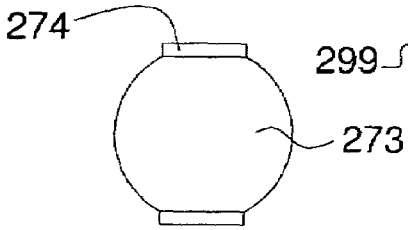
Figures 2, 2B, 3:
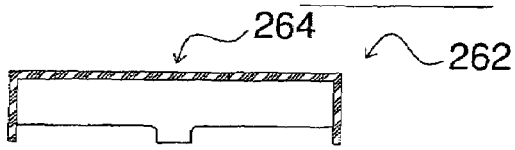
Figures 2, 2B, 3, 4, 5:
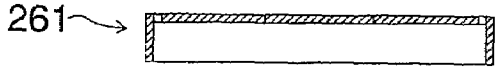
Figures 2, 2B, 3, 4, 5, 6, 7, 8:
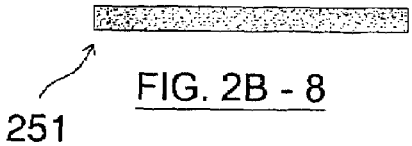
Figures 2, 2B, 3, 4:
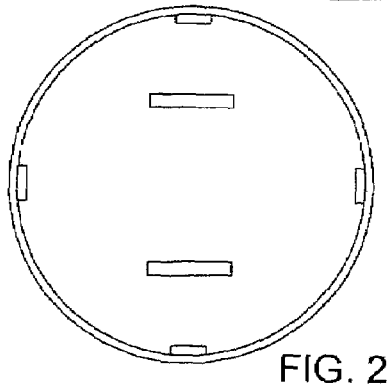
Figure 3:
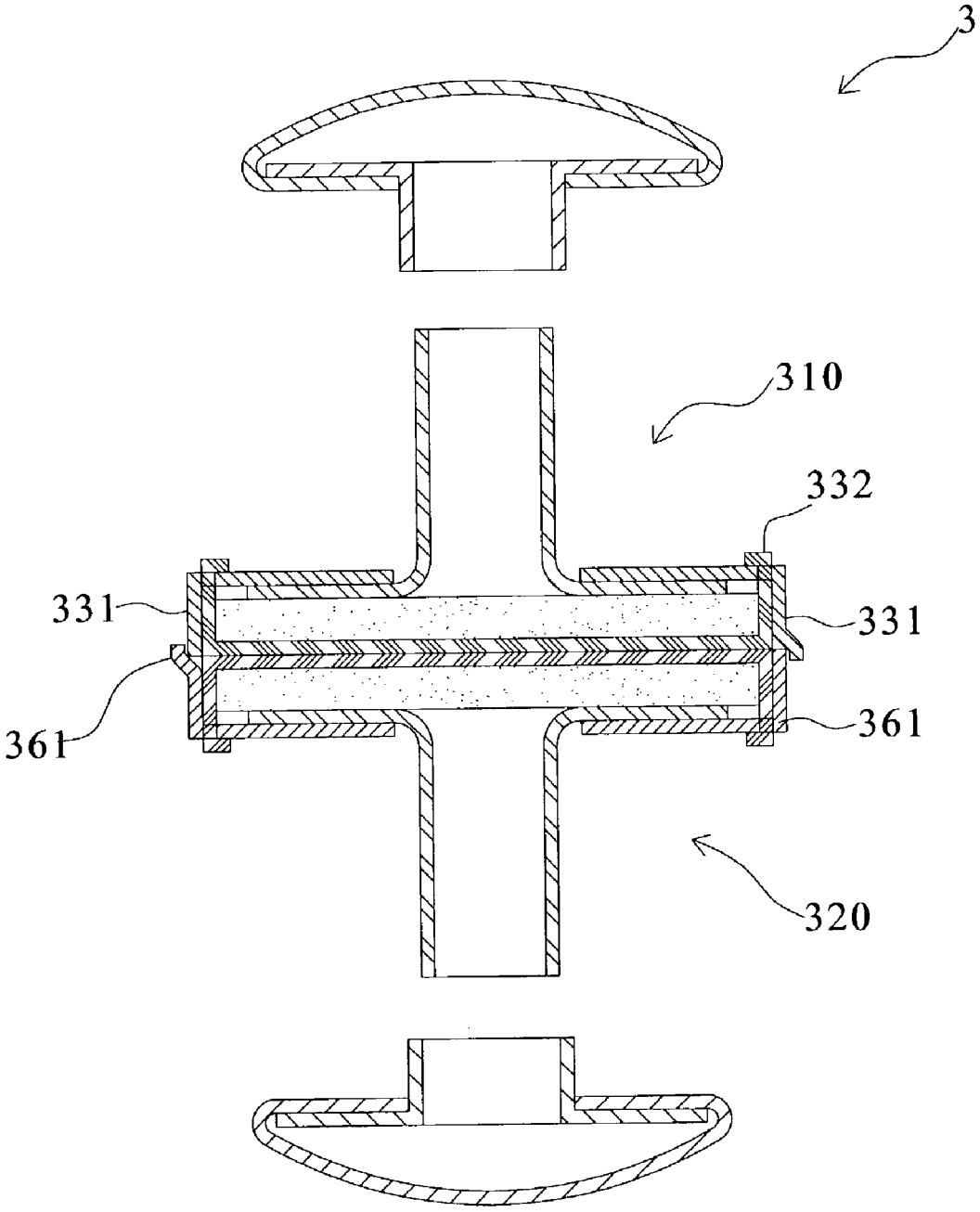
Figure 3A:
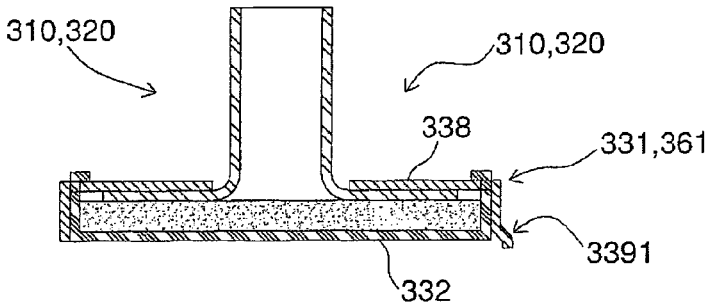
FIG. 3A shows the longitudinal cross-sectional view of one of the counterpart magnetic fasteners of FIG. 3, FIGS. 3A-1 and 3A-2 respectively show the bottom plan view and the cross-sectional view of parts 331 and 361, FIGS. 3B-1 and 3B-2 respectively show the cross-sectional and plan views of a modified form of the first and second housing parts 331 and 361 which can be used for the embodiment of FIG. 3.
Figures 1, 3A:
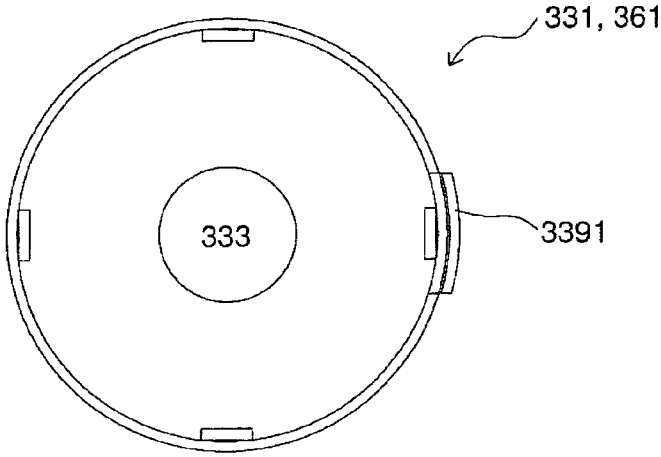
Figures 2, 3A:
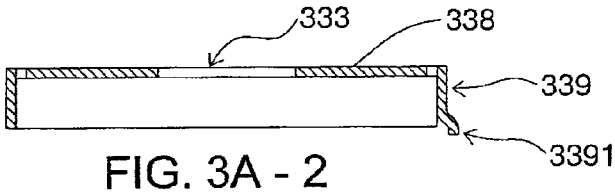
Figures 2, 3B:
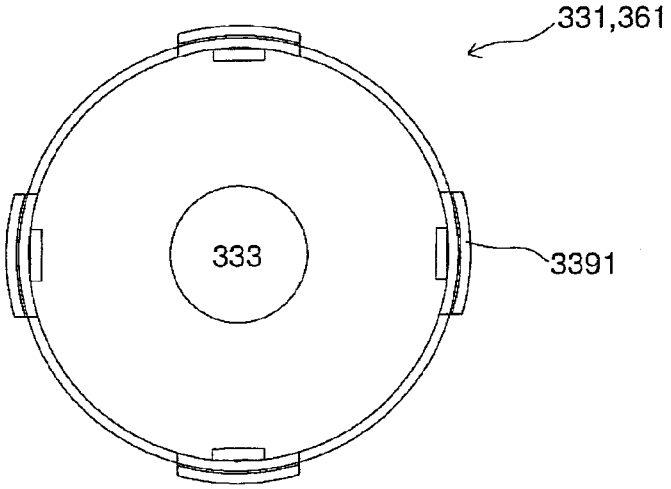
Figures 1, 3B:
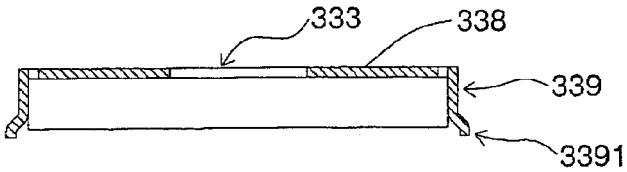

Referring to FIGS. 8 and 8A-1 to 8A-1 1, there is shown an eighth preferred embodiment of the present invention and its variations. The magnetic fastener 8 includes a first 810 and a second 820 fastening parts. One of the fastening parts includes a main housing, a ring-shaped magnet and attachment means. The main housing of the first fastening part includes a first housing part 831 and a second housing part 832 which, together, co-operate to define a receptacle for receiving the magnet 850. The second housing part 832 is provided with a depression substantially conforming to the contour and profile of the ring-shaped magnet. The sub-assembly comprising the first housing part 831,the ring-shaped magnet 850 and the second housing part 832 is then connected together by, for example, riveting. The first housing part, the second housing part and the rivet 890 is preferably made of a magnetic material so that magnetic flux originating from the permanent magnet table 850 can penetrate through the magnetic coupling surface 851 and, at the same time, the magnetic flux from the back polar surface of the permanent magnet tablet 850 can be redirected and concentrate at the ends of the rivet 890 for enhanced magnetic coupling. A plurality of sewing holes 870 are formed on the periphery of the second housing part. The second fastening part 820 includes a main housing 861 of magnetic material. Additional sewing holes 880 can be formed on the rear surface of the main housing part 861 as shown in FIG. 8A-10 for more secured and reliable attachment to the article.

Referring to FIGS. 9, 9A–9C, 9A-1 to 9A-8 and 9B-1 to 9B-4, there are shown a ninth preferred embodiment of a magnetic fastener 9 and its variations. The magnetic fastener 9 includes a first fastening part 910 and a second fastening part 920. The first fastening part 910 includes a main housing, a fastening structure and a ring-shaped magnet slab. The main housing includes a first housing part 931 and a second housing part 932 which are assembled together to form a receptacle 935 for receiving the ring-shaped magnet 950. The first housing part 931 is made of a magnetic permeable substance such as plastics, ABS, PVC or rubber and is formed to conform to the shape of the ring-shaped magnet or a ring-shaped magnetic sub-assembly. The first housing part 931 and the second housing part 932 together with the ring-shaped magnet form a sub-assembly of the magnetic fastener. A ring-shaped back cover 941, 972 can be attached to the first housing part 931 and the second housing Dart 961 to make the fastening parts water- and rust-proof. The back cover is preferably made of a material which is compatible with the first housing part 931 so that they can be melted, soldered or pasted together.

The second housing part is made of a magnetic material so that the magnetic flux originating from the permanent magnet slab 951 can pass through the magnetic coupling surface while the magnetic flux originating from the other side of the permanent magnet can be re-directed to appear on the magnetic coupling surface. A plurality of sewing holes are formed on the first housing part for attaching to a flexible surface in a conventional manner. The first housing part of the first fastening part 910 includes a protruding portion 939 while the first housing part 961 of the second fastening part 920 includes a protrusion 999 so that the corresponding parts form a co-operative receiving mechanism to prevent the magnetic coupling surfaces from relative sliding movements. The first housing part 961 and the second housing part 962 of the second fastening part 920 are generally identical to the corresponding parts of the first fastening part. In addition, the main housing 931 and the back cover 942 of the first fastening part also provided with a plurality of sewing holes in order to enhance the stability and attachability of the fastening parts on the relevant surfaces.

Referring to FIGS. 10 and 10A–10D, there are shown a tenth preferred embodiment of a magnetic fastener 10 and its variations. The magnetic fastener 10 includes a first fastening part 1010 and a second fastening part 1020. The first fastening part 1010 includes a main housing 1031, a fastening part 1042 and a ring-shaped permanent magnet 1050. The main housing includes a first housing part 1031 and a second housing part 1042 which, when assembled together, form a magnet receptacle for receiving the ring-shaped magnet. The first housing part 1031 is made of a magnetic permeable material such as copper, stainless steel, plastics, ABS, PVC or rubber and is formed with a compartment conforming to the shape of the ring-shaped magnet 1050 or a ring-shaped magnetic assembly. The first housing part 1031, the second housing part 1042 and the ring-shaped magnet 1050 are assembled together to form a magnetic sub-assembly of the magnetic fastener. The first housing part 1031 is provided with a ring-shaped back cover and is sealed with a sealing member so that the fastener is substantially water-proof and rust-proof. The back cover can be fastened onto the first housing part 1031 by the plurality of upstanding fingers 1037. The back cover 1042 is preferably made of a material compatible with that of the first housing part 1031 so that they can be melted, soldered or welded together.

The magnetic coupling surface of the housing part 1061 of the second fastening part 1020 is made of a magnetic permeable material so that the magnetic flux originating from one surface the permanent magnet slab 1050 can pass through the magnetic coupling surface and, at the same time, the housing parts include a basin-shaped main housing part 1061 so that the magnetic flux originating from the other back 1062 side of the permanent magnet can be re-directed by the back cover towards the magnetic coupling surface in order to enhance the magnetic coupling strength. Similarly, the back cover 1062 can be fastened to the main housing part by the plurality of upstanding fingers 1067. A plurality of sewing holes 1044 are provided in the first housing part.

Figure 10C:
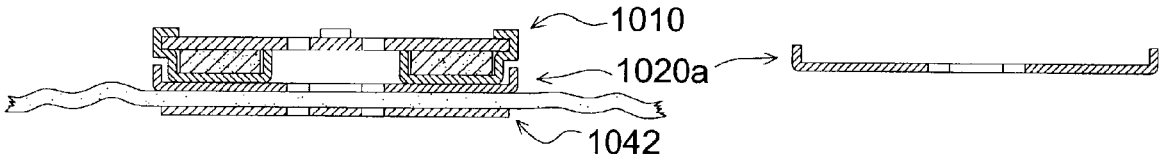
FIGS. 10C and 10D show its slight variations.
Figure 10D:
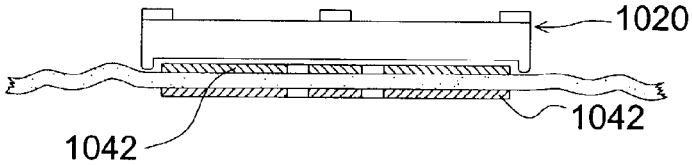

The first fastening part 1010 includes a protruding part 1039 while the second fastening part 1020 includes a correspondingly-shaped indentation part 1099, thereby forming a co-operative coupling mechanism which alleviates relative sliding between the coupling surfaces. The first 1010 and the second 1020 fastening parts are generally identical except for the portions which constitute the co-operative coupling mechanism (i.e. 1039 and 1099). A back plate 1042 with a plurality of sewing holes 1044 can form part of the first fastening part to improve the attachability and stability of the fastening part on a flexible surface such as that of apparel. FIGS. 10C and 10D shows variation of this preferred embodiment in which the second fastening part is made into a simple basin form 1020*a* of a magnetic material 1042 to simplify the overall structure. As shown in FIG. 10D, the second fastening part can be simply replaced by a magnetic basin 1042 of magnetic property to further simplify the overall structure.

While the present invention has been explained by reference to the preferred embodiments described above, it will be appreciated that the embodiments are only illustrated as examples to assist understanding of the present invention and are not meant to be restrictive on its scope. For example, the co-operative catching means between the first and the second fastening parts can be formed by having the third housing part (or the guarding means), i.e., parts 91 and 291, to include a narrowed portion at an axial level above the magnetic coupling surface connected with the third housing part. This narrowed portion is adapted so that the counterpart magnetic coupling surface can pass through the narrowed aperture of the third housing part along the axial direction and, at the same time, the narrowed aperture will resist passage of the counterpart magnetic coupling surface along a direction which is generally parallel to the mutual magnetic axis of the counterpart magnet tablets when under a lateral tension. In particular, the scope, ambit and spirit of this invention are meant to include the general principles of this invention as inferred or exemplified by the embodiments described above. More particularly, variations or modifications which are obvious or trivial to persons skilled in the art, as well as improvements made on the basis of the present invention, should be considered as falling within the scope and boundary of the present invention.

Furthermore, while the present invention has been explained by reference to magnetic fasteners with a magnet tablet in each of the fastening parts, it should be appreciated that the invention can apply, whether with or without modifications, to other variation, including a pair of fasteners with only a single magnet tablet, without loss of generality.

The invention claimed is:

1. A magnetic fastener comprising a first detachable fastening member, a second detachable fastening member and co-operative catching means, each said detachable fastening member comprising a magnetic coupling surface with a characteristic magnetic axis, said first and second detachable fastening members being in a fastening connection when the corresponding magnetic coupling surfaces of said first and second detachable fastening members are under magnetic coupling and have a common magnetic axis, wherein said first and second detachable fastening members are detachable from said fastening connection when subject to an axial separation force which is applied along said common magnetic axis, and said co-operative catching means confines the magnetic coupling surfaces of said first and second detachable fastening members under mutual magnetic attraction when said first and second detachable fastening members are in a fastening connection and subject to a non-axial separation force which is applied at an angle to said common magnetic axis, wherein said co-operative catching means comprises a catch compartment and a latch portion, said catch compartment is formed on said second detachable fastening member and comprises a peripheral boundary and a circumferential flange inwardly extending from said peripheral boundary, said catch compartment defines a compartment within which said first and said second detachable fastening members are relatively moveable while under magnetic attraction, and said latch portion is formed on said first detachable fastening member and comprises a circumferential flange which extends radially outward from said common magnetic axis, wherein said inwardly extending circumferential flange defines an entry aperture through which said first and said second detachable fastening members are engaged through magnetic coupling along said common magnetic axis and through which said first and said second fastening members are separated when subject to said axial separation force, wherein the co-operative catching means defines the maximum extent of allowable relative transverse displacement between the corresponding magnetic coupling surfaces when said first and second detachable fastening members are subject to a non-axial separation tension, wherein each said first and second detachable fastening members comprises a permanent magnet and each said permanent magnet is embraced by a magnetic housing, and said permanent magnet is embraced so that the magnetic field on a backside of the permanent magnet which is distal from the magnetic coupling surface is brought to the side of the magnetic coupling surface whereby regions of magnetic field of opposite magnetic polarity and a common magnetic axis are present on said magnetic coupling surface, and wherein said permanent magnet is also embraced by a non-magnetic housing, said magnetic housing embraces both said permanent magnet and said non-magnetic housing, and said magnetic housing forms the outer periphery of said magnetic coupling surface and circumferentially surrounds the permanent magnet.

2. A magnetic fastener according to claim 1, wherein said outwardly extending circumferential flange of said first detachable fastening member is at an elevation which is below the inwardly extending circumferential flange of said second detachable fastening member when said corresponding magnetic coupling surfaces are in a fastening connection.

3. A magnetic fastener comprising a first detachable fastening member and a second detachable fastening member, said first and said second detachable fastening members respectively comprising first and second magnetic coupling surfaces which are magnetically attracted towards each other along an axial magnetic coupling direction, said magnetic fastener further comprising guarding means which is disposed on one of said first and second detachable fastening members, said guarding means being spaced apart from said magnetic coupling surfaces to allow relative lateral movement between said magnetic coupling surfaces while resisting relative lateral movements between said first and said second magnetic coupling surfaces beyond a maximum allowable extent when said first and said second fastening members are under magnetic coupling, said first and second fastening members further comprising co-operative catching means which is adapted to resist disengagement of said first and second fastening members generally along said axial magnetic coupling direction when said first and second fastening members are simultaneously under magnetically coupling and subject to lateral tensions applied transverse to said axial magnetic coupling direction, said co-operative catching means being adapted to allow axial separation of said first and second fastening members along said magnetic coupling direction with said coupling surfaces in parallel and orthogonal to said magnetic coupling direction and adapted to resist skewed separation of said first and second fastening members, wherein said co-operative catching means comprises a catch portion with a circumferential flange extending radially inwards and a latch portion with a circumferential flange extending radially outwards, the radial extension of said latch portion and said catch portion being such that their respective movements along said axial magnetic coupling direction are clear of each other so that said first and second fastening members can be separated axially along the magnetic coupling direction unobstructed, each of said first and second magnetic coupling surfaces being surrounded by a magnetic housing made of a magnetic material, said magnetic housing extending from the backside of a magnetic coupling surface towards the front-side of said magnetic coupling surface so that the magnetic polarity of said magnetic housing is opposite to that of the corresponding surrounded magnetic coupling surface, the corresponding magnetic housings of said first and second detachable fastening members being shaped and dimensioned so that when said first and second magnetic coupling surfaces are in magnetic coupling contact, the corresponding magnetic housings are also in magnetic coupling contact.

4. A magnetic fastener according to claim 3, wherein each of said first and said second detachable fastening members includes a non-magnetic housing which surrounds said magnetic coupling surface, said non-magnetic housing being intermediate said magnetic housing and said magnetic coupling surface and for securing said magnetic coupling surface in place.

5. A magnetic fastener comprising a first detachable fastening member and a second detachable fastening member, said first and said second detachable fastening members respectively comprising first and second magnetic coupling surfaces which are magnetically attracted towards each other along an axial magnetic coupling direction, said magnetic fastener further comprising guarding means which is disposed on one of said first and second detachable fastening members, said guarding means being spaced apart from said magnetic coupling surfaces to allow relative lateral movement between said magnetic coupling surfaces while resisting relative lateral movement between said first and said second magnetic coupling surfaces beyond a maximum allowable extent when said first and said second fastening members are under magnetic coupling, said first and second fastening members comprising co-operative catching means which is adapted to resist disengagement of said first and second fastening members generally along said axial magnetic coupling direction when said first and second fastening members are simultaneously under magnetic coupling and subject to lateral tensions applied transverse to said axial magnetic coupling direction, said co-operative catching means comprising means which allows axial separation of said first and second fastening members along said magnetic coupling direction with said coupling surfaces in parallel and orthogonal to said magnetic coupling direction and means to resist skewed separation of said first and second fastening members, further including a ring-shaped magnet or a ring-shaped magnetic assembly and a housing on which said magnet or said magnetic assembly is held, said housing including a plurality of sewing holes which are disposed in the region of said housing corresponding to a central aperture of said ring-shaped magnet or ring-shaped magnet assembly.

* * * * *